US005779029A

United States Patent [19]

Gershfeld

[11] Patent Number: 5,779,029

[45] Date of Patent: Jul. 14, 1998

[54] DEVICE FOR SETTING ACTUATORS OF A DIP SWITCH IN DESIRED POSITIONS

[76] Inventor: Jack Gershfeld, 273 Brookshire Pl., Brea, Calif. 92821

[21] Appl. No.: 912,504

[22] Filed: Aug. 18, 1997

[51] Int. Cl.[6] ..... H01H 3/20

[52] U.S. Cl. ..... 200/330; 200/331

[58] Field of Search ..... 200/330, 329, 200/339, 331, 43.14, 43.15, 43.11

[56] References Cited

U.S. PATENT DOCUMENTS 5,593,020 1/1997 Alexander ..... 200/43.16

*Primary Examiner*—David J. Walczak

[57] ABSTRACT

A device for setting actuators of a DIP switch is desired positions. A device having a number of notches and protrusions on an edge thereof can be swiped over the actuators of a DIP switch thereby causing the protrusions to engage and move desired actuators into the "on" position, whereas the notches on the device will slide over the actuators without engagement thereby keeping those actuators in the "off" position.

5 Claims, 4 Drawing Sheets

DEVICE FOR SETTING ACTUATORS OF A DIP SWITCH IN DESIRED POSITIONS

BACKGROUND OF THE INVENTION

This invention relates to a dual-in-line package (DIP) switch, or single-in-line package (SIP) switch, more particularly to a device for setting actuators of a DIP switch in desired positions. DIP switches are widely used in the area of electronics for configuring defaults on computer boards, selecting baud rate on modems, setting default for video cards, configuring pin-outs on cables, and other applications. Ordinarily, DIP switches have a plurality of outwardly extending actuators which can be moved in the "on" or "off" position depending on the requirements of a particular application. These actuators are normally numbered, and the product that uses DIP switches comes with instructions as to the positions of the actuators.

For example, an instruction for a DIP switch setting may call for the actuator 1 to be switched in the "on" position, the actuator 2 in the "off" position, the actuators 3 and 4 in the "on" position and so forth.

Due to the diminutive sizes of most DIP switches, as well as location of DIP switches in the areas difficult to access, setting actuators of a DIP switch in desired positions may be a laborious and finicky undertaking. Normally, actuators are set in desired positions one by one with a sharp object, such as a pencil. Further, different applications require different settings and different sets of instructions. Instructions may be lost or confused between the applications.

Therefore, there is a need for a simple and inexpensive device making the process of setting actuators of a DIP switch in desired positions simple and convenient.

SUMMARY OF THE INVENTION

The present invention satisfies this need. This invention discloses a device for setting actuators of a DIP switch in desired positions in a form of a plate having a number of notches and protrusions on the edge. These notches and protrusions are located in a way that aligning said notches and protrusions with actuators of a DIP switch and swiping said edge over the actuators switched in the "off" position will cause said protrusions to engage and move desired actuators in the "on" position. On the other hand, the notches on the device will slide over the actuators without engaging actuators, keeping them in the "off" position.

In order to properly align the notches and protrusions with the corresponding actuators of the DIP switch, there is provided numbers for each notch and protrusion so that notch (or protrusion, whatever the case may be) number 1 can be aligned with the actuator number 1. The notch (or protrusion) number 2 will be aligned with the actuator number 2, and so forth. In practice, aligning only one notch or protrusion with the corresponding actuator will cause the rest of the notches and protrusions to be properly aligned with the corresponding actuators. Accordingly, it is sufficient to provide a mark or any other means for aligning only one notch or protrusion with the corresponding actuator. It is most convenient, but not necessary to provide a mark permitting alignment of the notch (or protrusion) number 1 with the actuator number 1.

It is also desirable to indicate the particular application on the device for setting the actuators. For example setting modem into 4800 baud mode would be indicated on the side of the device. A separate device may be provided for each particular setting that may be required. Alternatively, a single device may have several combinations of notches and protrusions corresponding to different settings of actuators located on different edges of the device.

DESCRIPTION OF THE DRAWINGS

The advantages of this invention will be better understood with the reference to the following drawing figures and description of the preferred embodiments of this invention.

DESCRIPTION OF THE PREFERRED EMBODIMENTS

Figure 1:
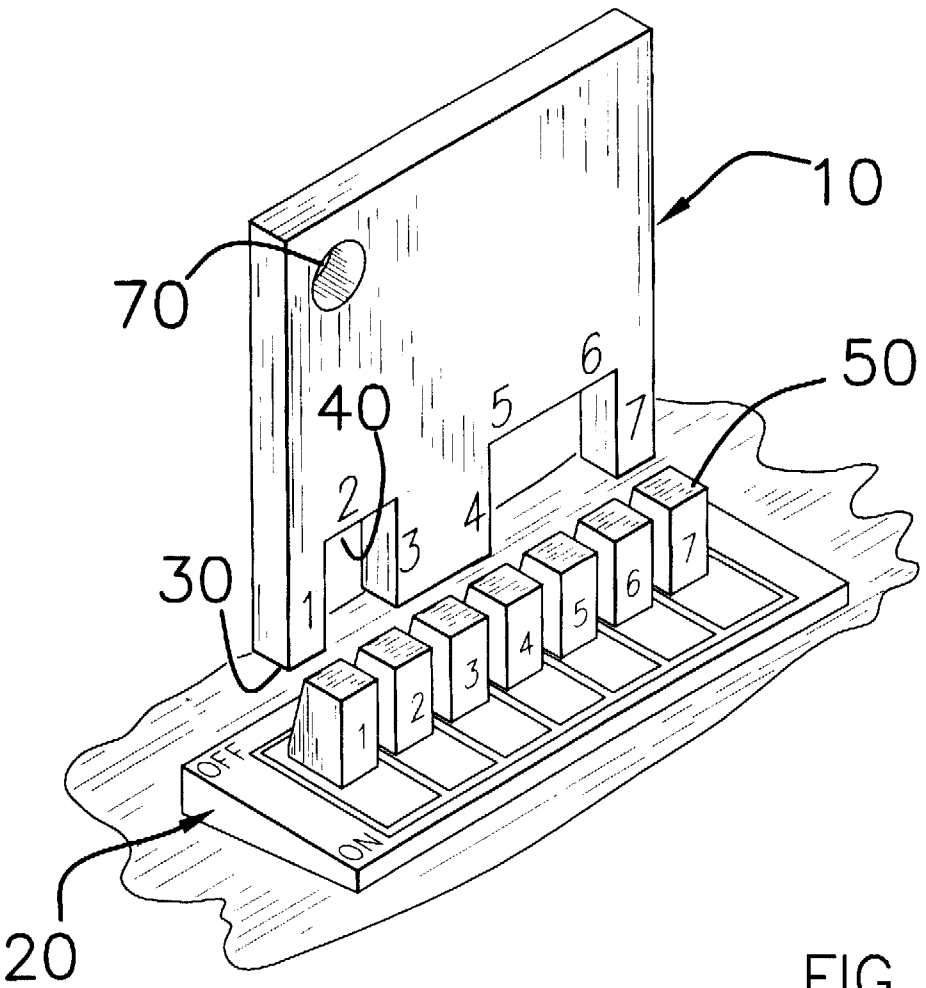
FIG. 1 is an illustration of the device for setting actuators of a DIP switch in desired positions in a form of a plate having notches and protrusions on the edge, aligned with the actuators of a DIP switch.

Referring to FIG. 1, numeral 10 indicates an actuators setting device in a form of a plate, numeral 20 indicates a DIP switch, numeral 30 indicates protrusions located on the edge of actuators setting device 10, numeral 40 indicates notches located on the edge of actuators setting device 10, numeral 50 indicates actuators located on DIP switch 20. Actuators 50 are numbered, respectively, 1, 2, 3, 4, 5, 6, and 7. Protrusions 30 are numbered, respectively, 1, 3, 4, and 7. Notches 40 are numbered, respectively, 2, 5, and 6.

In this example, it is desired to switch Actuators 50 as follows:

1. Actuator number 1 in the "on" position;
2. Actuator number 2 in the 'off' position;
3. Actuators number 3 and 4 in the "on" position;
4. Actuators number 5 and 6 in the "off" position;
5. Knob number 7 in the "on" position.

Accordingly, actuator number 1 is aligned with protrusion number 1; actuator number 2 is aligned with notch number 2; actuators number 3 and 4 are aligned with protrusions number 3 and 4; actuators number 5 and 6 are aligned with notches number 5 and 6; actuator number 7 is aligned with protrusion number 7.

In order to set actuators 50 in the desired positions, actuators 50 need to be first switched in the "off" position, then actuators setting device 10 with protrusions 30 and notches 40 aligned as described above, needs to be swiped over actuators 50. This will cause protrusions number 1, 3, 4, and 7 to engage, respectively, actuators number 1, 3, 4, and 7 resulting in the actuators number 1, 3, 4, and 7 to be switched in the "on" position. On the other hand, notches number 2, 5, and 6 will slide over, actuators number 2, 5, and 6, respectively without engaging said actuators, resulting in actuators number 2, 5, and 6 remaining switched in the "off" position.

Actuators setting device 10 is also equipped with an opening 70 which allows to attach actuators setting device 10 to a key chain ring or other arrangement. Opening 70 is not a necessary feature of this invention but merely a convenience. For example, several actuators setting devices 10 with different combinations of notches and protrusions for different settings can be attached to a key chain ring to prevent loss of one of actuators setting devices 10. Opening 70 can be located anywhere on actuators setting device 10 as long as it does not interfere with protrusions 30 and notches 40.

Figure 2:
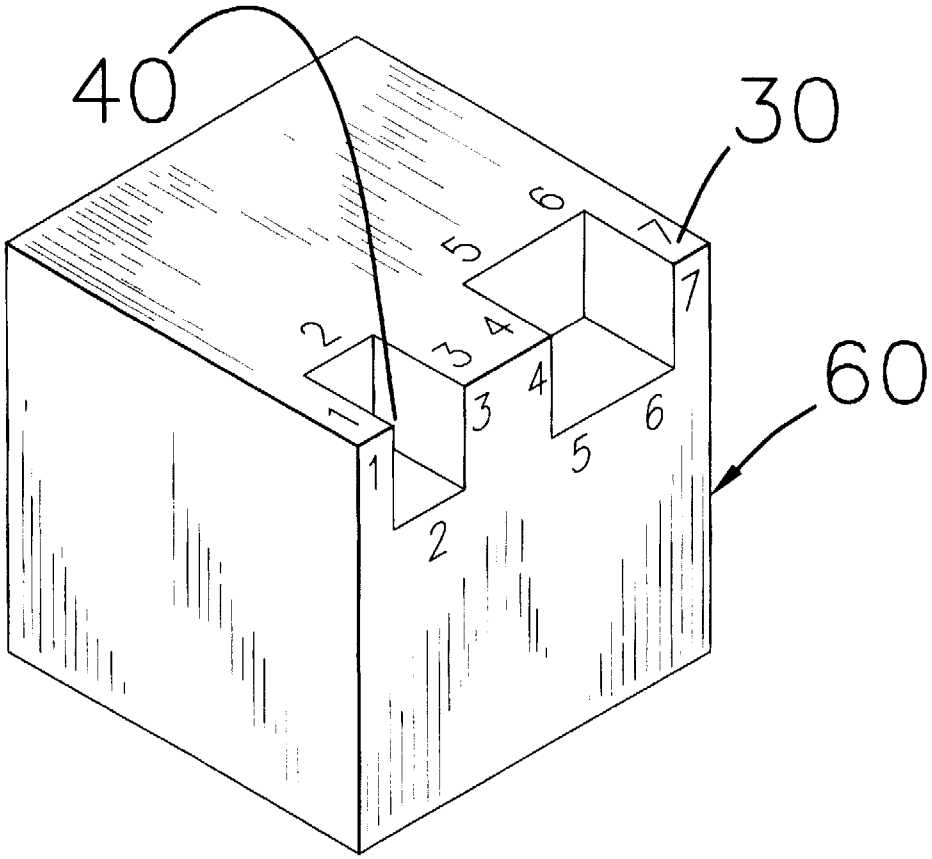
FIG. 2 is an illustration of the device for setting actuators of a DIP switch in desired positions in a form of a cube.

Referring now to FIG. 2, numeral 60 indicates an actuators setting device in a form of a cube. Similar to FIG. 1, numeral 30 indicates notches located on the edge of actuators setting device 60. Numeral 40 indicates protrusions located on the edge of actuators setting device 60. The combination of protrusions 30 and notches 40 is the same as described in reference to FIG. 1. Similarly to actuators setting device 10, actuators setting device 60 can be swiped over actuators 50 of DIP switch 20 in order to set actuators 50 in the desired positions.

Actuators setting device 60 can have several combinations of protrusions 30 and notches 40 located on different edges. Further, even though the most convenient shape for actuators setting device 60 is a cube, actuators setting device 60 can be shaped as a rectangular or any other shape. The only practical limitation to the shape of actuators setting device 60 is the ability to locate protrusions 30 and notches 40.

Figure 3:
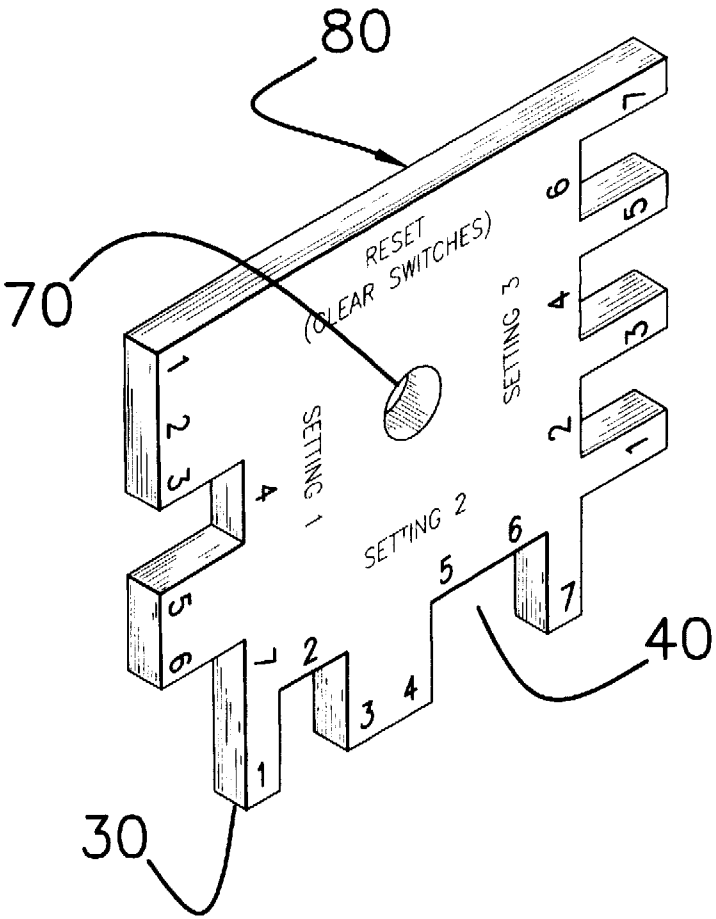
FIG. 3 is an illustration of the device for setting actuators of a DIP switch in desired positions that has four combinations of notches and protrusions located on different edges with each combination used for a different DIP switch setting.

Referring now to FIG. 3, numeral 80 indicates an actuators setting device having three combinations of protrusions 30 and notches 40 located on three different edges. The settings are indicated near protrusions 30 and notches 40 corresponding to the settings. The edge of actuators setting device 80 which does not have protrusions 30 and notches 40 can be used to reset DIP switch by moving actuators in the "off" position before swiping the edge of actuators setting device 80 having the desired setting.

Figure 4:
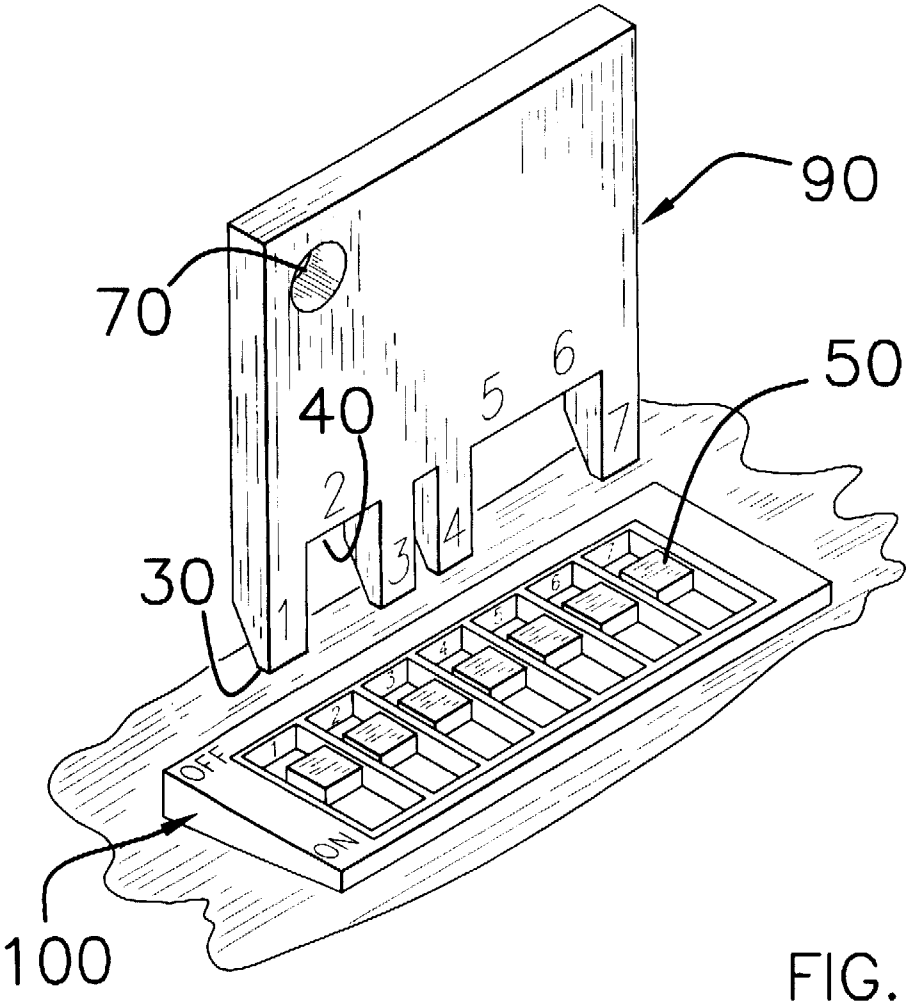
FIG. 4 is an illustration of the device for setting actuators of a DIP switch in desired positions that can be used with a DIP switch having recessed actuators.

Referring now to FIG. 4, numeral 90 indicates an actuators setting device that can be used with DIP switches equipped with recessed actuators. Numeral 100 indicates a DIP switch in which actuators 50 are recessed. The only difference between actuators setting device 90 and actuators setting device 10, described in reference to FIG. 1, is that protrusions 30 in actuators setting device 90 are shaped to fit in the recessed areas of DIP switch 100 where actuators 50 are located. Further, protrusions 30 located next to one another are separated by a notch. For example, still viewing FIG. 4, protrusions 30 numbered 3 and 4 are separated by a notch. On the other hand, protrusions 30 numbered 3 and 4 in FIG. 1 do not have to be separated by a notch.

What is claimed is:

1. A device for setting a plurality of actuators extending from a DIP switch in a desired position wherein the actuators are disposed adjacent to each other comprising:

a plate having a plurality of edges thereon;

at least one notch sized to enable at least one of the actuators to pass therethrough and at least one protrusion sized to contact and thereby set at least one of the actuators wherein said at least one notch and said at least one protrusion are positioned along one of said edges whereby when said plate is passed over the plurality of actuators, at least one actuator to be set is contacted and moved by said at least one protrusion to another position and at least one of the actuators not to be set is passed through said at least one notch and thereby remaining in an initial position.

2. A device as defined in claim 1, and further including indicia on said at least one protrusion for indicating which of the at least one actuator will be contacted when said plate is passed over the plurality of actuators.

3. A device as defined in claim 1, and further including an opening in said plate for receiving a key chain ring.

4. A device for setting a plurality of actuators extending from a DIP switch in a desired position wherein the actuators are disposed adjacent to each other comprising:

a cube having a plurality of edges thereon;

at least one notch sized to enable at least one of the actuators to pass therethrough and at least one protrusion sized to contact and thereby set at least one of the actuators wherein said at least one notch and said at least one protrusion are positioned along one of said edges whereby when said cube is passed over the plurality of actuators, at least one of the actuators to be set is contacted and moved by said at least one protrusion to another position and at least one of the actuators not to be set is passed through said at least one notch and thereby remaining in an initial position.

5. A device as defined in claim 1, and further including indicia on said protrusions for indicating which of the at least one actuators will be contacted when said cube is passed over the plurality of actuators.

* * * * *